United States Patent [19]

Heimlicher et al.

[11] 4,036,487

[45] July 19, 1977

[54] SHEET FOLDING APPARATUS

[75] Inventors: Paul Heimlicher, Bolligen; Eduard Von Hein, Bern, both of Switzerland

[73] Assignee: Maschinenfabrik Wifag, Bern, Switzerland

[21] Appl. No.: 611,807

[22] Filed: Sept. 9, 1975

[30] Foreign Application Priority Data

Sept. 12, 1974 Sweden ..... 7411525

[51] Int. Cl.[2] ..... B65H 45/16

[52] U.S. Cl. ..... 270/71; 270/78

[58] Field of Search ..... 270/72, 71, 70, 21, 270/74–78, 42, 49, 50

[56] References Cited

U.S. PATENT DOCUMENTS

| | | | |
|---|---|---|---|
| 1,672,935 | 6/1928 | Goodwin | 270/78 |
| 2,026,443 | 12/1935 | Tomlin | 270/42 |
| 2,706,628 | 4/1955 | Huck | 270/72 |
| 3,231,261 | 1/1966 | Huffman | 270/72 |
| 3,640,522 | 2/1972 | Oelmann | 270/72 |
| 3,689,061 | 9/1972 | Nystrand | 270/72 |

*Primary Examiner*—Edgar S. Burr

*Assistant Examiner*—A. Heinz

*Attorney, Agent, or Firm*—Toren, McGeady and Stanger

[57] ABSTRACT

Apparatus for forming in a sheet a fold extending transversely of the direction of sheet travel therethrough is provided with a triad of cylinders rotating about parallel axes. The sheets to be folded are first engaged about the periphery of a first of said triad of cylinders with their trailing and leading edges engaged by releasable grippers. A folding blade located between said grippers on said first cylinder causes a portion of the sheet intermediate the leading and trailing end thereof to be engaged by a folding flap provided on a second of said triad of cylinders. The folding flap engages the sheet at an intermediate point thereon and draws the sheet off said first cylinder while the sheet ends are positively held in a controlled manner. The third of said triad of cylinders cooperates by engaging the leading end of said sheet as said sheet is drawn off said first cylinder by the second cylinder. Thus, the transverse fold is formed in the sheet while the trailing and leading ends of the sheet are supported to avoid the occurrence of distortions of the folded sheet.

3 Claims, 6 Drawing Figures

SHEET FOLDING APPARATUS

BACKGROUND OF THE INVENTION

The present invention relates generally to apparatus for folding sheets, and more particularly, to apparatus for forming in a sheet a fold which extends transversely to the direction of sheet travel through the apparatus. The invention is particularly useful in folding paper sheets produced in rotary roller printing presses.

Virtually all sheet folding devices of prior art configuration are designed so that a paper sheet to be folded originating from a transverse cutting of a paper is guided and tranported by needles or grippers until it is engaged by a combination of a folding-blade jaw device or folding-blade folding rollers device which operates to effect guidance of the sheet. Under the influence of centrifugal forces, the cut paper sheet is guided at its front or leading edge and exhibits a tendency to be raised or lifted off a cylindrical surface upon which the sheet is supported during the folding operation. Such an approach to the folding of paper sheets involves several disadvantages. First of all, the location where a folding blade strikes the paper sheet during the folding process is generally dependent upon the speed of operation of the device and for this reason the fold to be formed shifts during operation because the paper sheet will be moved forwardly if it assumes a radius greater than the radius of the cylinder upon which it is supported. Secondly, the paper sheet will assume a speed which is greater than the circumferential speed of the folding cylinders of the device because it will move along a larger radius. This excess speed imparted to the sheet must be compensated for and as a result there will occur the formation of dog ears or cross-wrinkles in the sheet.

Accordingly, distortions in the folded sheet will occur unless the sheet is properly controlled and supported throughout the folding process.

Attemps have been made to control and appropriately guide the sheet in the process of the formation of the fold. Fixed tongues have been mounted only at a particular distance from the surface of the rotating cylinder upon which the sheet is supported in order to avoid jamming of the apparatus. However, it has been found that the sheet will still become elevated or lifted from the cylinder surface to a certain undesirable degree. Tapes or brushes rotating in synchronism and located forwardly of the juncture of the jaw cylinder or the folding rollers may operate to maintain control of the sheet but only to a point shortly before the juncture. Clamping devices on the surfaces of the cylinders of the apparatus are effective only until the end of the sheet has barely passed thereby whereupon the sheet is released. Compensation of the excess speed and catching or binding of the sheet end which attempts to move tangentially away from the cylinders is ordinarily performed by guide tongues, tapes, brushes and the like located on the discharge side of the cylinder mechanism forming the third side of a triangular chamber located between the folding cylinders of the device. It is the shape of the third side of this triangular chamber which determines whether the sheet end will be transported through the folding apparatus without cross wrinkles, dog ears or other distortions. Usually, the most favorable configuration for such a device is determined experimentally depending upon the weight and speed of the paper which is to be handled. However, when these parameters are varied, damage to the sheet must be anticipated unless the shape of the third side of the triangular chamber formed between the folding rollers or cylinders is changed in accordance with the changed parameters.

With each cross fold which is formed, the sheet edge which originally was the leading edge tends to become the trailing edge of the sheet because of a reversal of sheet direction. That is, when the folding blade jaw flap assembly or the folding blade folding roller assembly has gripped the sheet, this phenomenon tends to occur. The leading portion of the sheet is decelerated to zero and is subsequently accelerated in a reversed direction in accordance with the peripheral speed of the rotating cylinder. Such a sheet end is then generally uncontrolled to the same extend as the trailing end of the sheet and when the two ends of the sheet meet somewhere within the triangular chamber formed between the rotating cylinders, a completely uncontrolled motion of the sheet-ends tends to occur thereby causing cross wrinkles, dog ears or other distortions to arise in the configuration of the folded sheet.

The present invention is directed toward providing a folding device for forming a transverse fold in a paper sheet which is produced in a rotary roller printing press, the device of the present invention being intended to preclude the formation of undesired wrinkles, dog ears or other distortions in the sheet to be folded.

SUMMARY OF THE INVENTION

In accordance with the general concepts of the present invention, the problems arising with prior art devices are solved in that a paper sheet which is in the process of being folded is successively engaged or retained at three points thereon and is positively supported and guided through the mechanism of the invention until the transverse fold is completed. The folding operation of the invention is accomplished by a triad of cylinders rotating about parallel axes. The sheet leading edge is first engaged on a gripper located on the periphery of a first collector cylinder as the sheet is guided about the periphery of the first cylinder the trailing edge thereof is engaged by a second gripper means. A folding blade is located on the first cylinder at a point intermediate the means gripping the trailing and leading edge of the sheet. At an appropriate point in the rotation of the cylinder, the folding blade causes an intermediate point on the sheet to be engaged by a jaw located on the second cylinder. Thus, the second cylinder grips the sheet at an intermediate point thereon and draws the sheet away from the first cylinder as the two cylinders rotate in a cooperative relationship. As the paper sheet is drawn from the first cylinder, the ends thereof tend to become disengaged from the gripper means. It is during this point in the operation of the device that wrinkles or distortions in the sheet may occur. In accordance with the invention, both ends of the sheet are positively supported until they are withdrawn from the gripper means of the first cylinder and then the leading edge of the sheet is engaged by a gripper on the third of the triad of cylinders thereby causing the leading edge of the sheet to be withdrawn in a supported and controlled manner to avoid the formation or folds or creases. It will, of course, be understood that the leading edge of the sheet reverses direction during this operation inasmuch as the sheet is gripped by the second cylinder at an intermediate point thereon. Thus, as the sheet is drawn by said second cylinder, the intermediate point which is engaged by the jaw becomes, in essence, a leading end of the sheet with both the edges of the sheet becoming, in essence, trailing edges which are drawn about the periphery of the second cylinder. It is during this drawing operation that the transverse fold is formed and it is also necessary at this time to support the sheet ends in a controlled way to avoid formation of creases and wrinkles.

By a further aspect of the invention, the gripper means may be replaced by points which extend radially from the surface of the cylinders and obliquely thereof in a direction rearwardly taken relative to the travel direction of the sheet.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
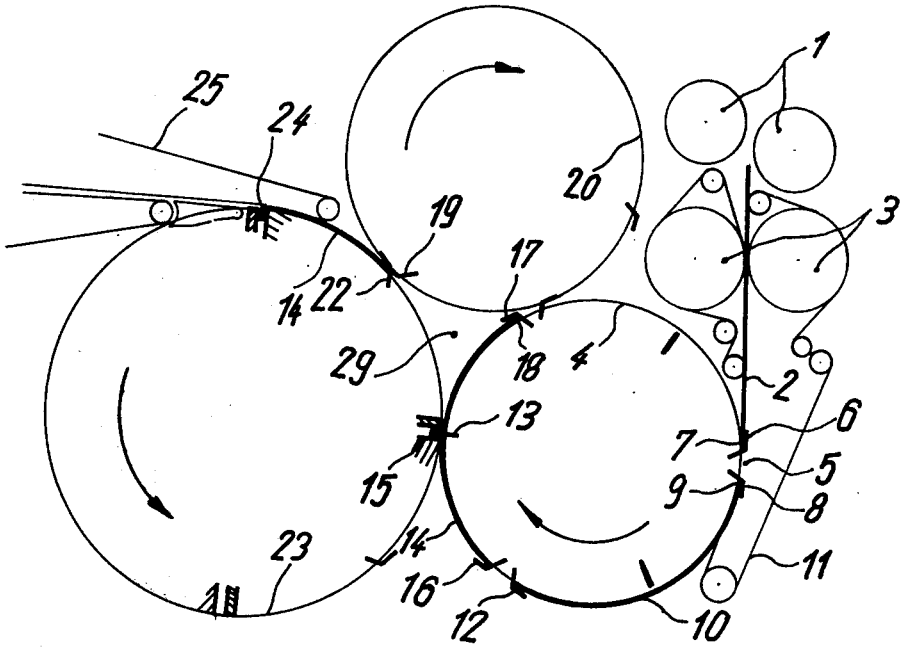
FIG. 1 is a schematic side view showing the apparatus of the present invention during the first stage of the folding process.

Referring now to FIG. 1 the apparatus of the present invention is depicted as including a cutting assembly comprising a pair of cylinders 1. The cylinders 1 cut the paper to be delivered to the apparatus and as a result a cut paper sheet 2 is accelerated from the cutting assembly to the peripheral speed of a collector cylinder 4 by operation of a pair of breakaway rollers 3. As the sheet passes from the breakaway rollers 3, a leading edge 7 of the sheet 2 becomes engaged by holding means 6 located on the collector cylinder 4 for firmly holding the leading edge 7.

It will be noted that the cylinder 4 has arranged thereabout two sheets 14 and 10 which have preceded the sheet 2 into engagement about the cylinder 4. It will also be noted that the sheet 14 has a leading edge 18 which has been engaged by holding means 17 and a trailing edge 21 (see FIG. 2) which is engaged by holding means 16. Similarly, the sheet 10 is engaged at its leading and trailing edges, respectively, by holding means 12 and 8. The holding means 6, 8, 12, 16 and 17 may comprise grippers which firmly engage and fixedly drive the sheets along their intended path of travel. Of course, the holding means may comprise other types of devices, as will be hereinafter described.

Thus, as a sheet such as for example the sheet 2 is brought from the breakaway rollers 3 into engagement about the peripheral surface of the cylinder 4, the leading edge of the sheet will be engaged by a leading edge gripper means and as the sheet moves forwardly its trailing edge also becomes engaged by a trailing edge gripper means.

As successive sheets are engaged in this manner about the cylinder 4, a gap or free space 5 is caused to be formed between a pair of adjacent sheets thereby enabling the holding means or grippers of the device to be accommodated on the cylinder 4.

The grippers, such as the grippers 12 and 8, hold the sheets i.e. the sheet 10, fully against the collector cylinder 4 in cooperation with a band line 11 which prevents any unwanted forward acceleration or movement of the sheet which might occur due to the influence of centrifugal force.

Figure 2:
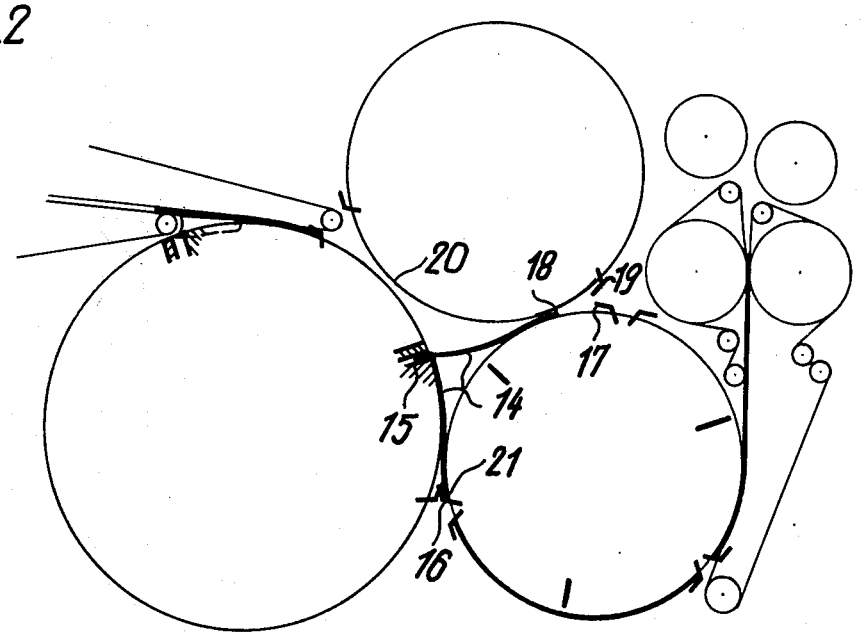
FIG. 2 shows the apparatus during a second stage of the folding process.

As the collector cylinder 4 continues turning, a folding blade 13 located intermediate the grippers for a given sheet, will push an intermediate portion of the sheet into engagement with a jaw 15 which is located on a folding flap cylinder 23. Referring particularly to the sheet 14, it will be seen that when the collector cylinder 4 is in the proper position, the folding blade 13 will push the sheet 14 at a point intermediate the grippers 16 and 17 into engagement with the jaw 15, the gripper 16 remaining closed while the gripper 17 opens. The gripper 17 must open at this point because of the fact that the leading edge 18 of the sheet 14 is now being drawn against the direction of rotation of the cylinder 4. This point in the operation of the device is best depicted in FIG. 2. Retardation of the sheet occurs under the influence of the jaw 15, which results in a pulling force being exerted on the leading part of the sheet 14. This maintains this part of the sheet stretched and thus under relative control.

Figure 3:
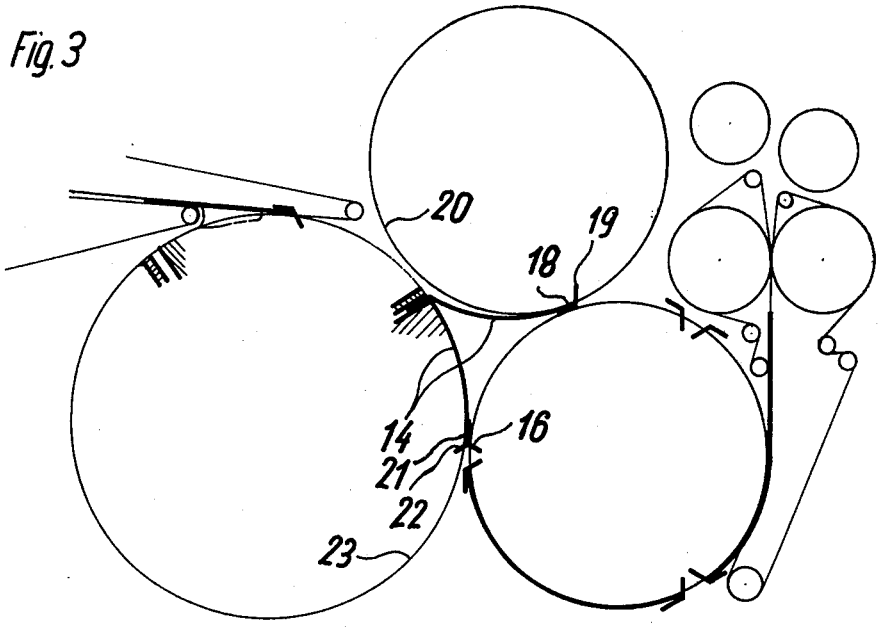
FIG. 3 shows the apparatus in a third stage of the folding process.

The acceleration of the sheet diminishes when the folding flap is in the position depicted in FIG. 3. At that moment, a gripper 19 of a third cylinder 20 will be brought into position to press the leading edge 18 of the sheet 14 against the cylinder 20, thus guiding this leading edge 18 and preventing it from undergoing uncontrolled or sporadic motion.

At about the same time, the gripper 16 must release the trailing edge of the sheet 14. In order to prevent trailing edge 21 from advancing tangentially, the gripper 22 pushes the sheet end 21 against the jaw cylinder 23. The sheet 14 is now held in three separate places; namely, at the edge 18 by the gripper 19, at the edge 21 by the gripper 22 and at its intermediate or midpoint by the jaw 15. The two edges 18 and 21 are now automatically led together in a positively controlled manner throughout the process of formation of a transverse fold 24 shown in FIG. 1. Thereupon, the two grippers 19 and 22 release the sheet edges.

After the jaw 15 opens, transport of the sheet is effected by a band line 25.

Figure 4:
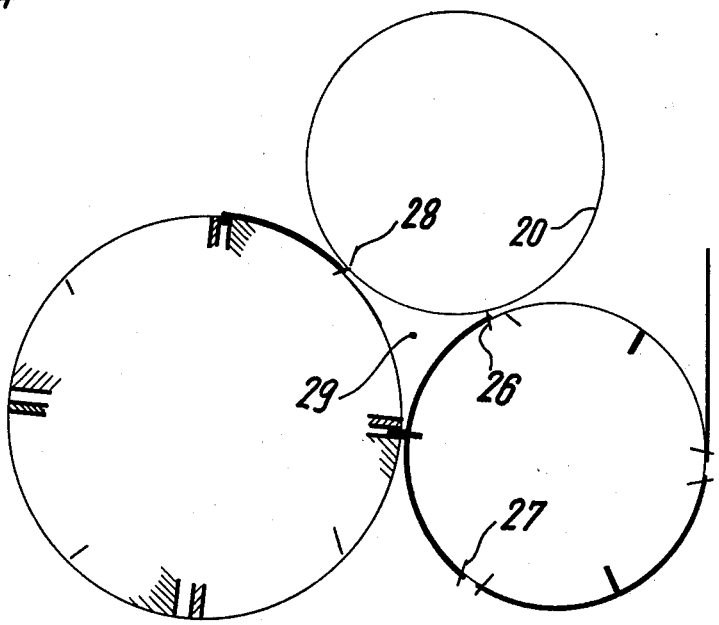
FIG. 4 is a schematic side view showing a further aspect of the invention wherein points are utilized for holding the ends of the sheet.
Figure 5:
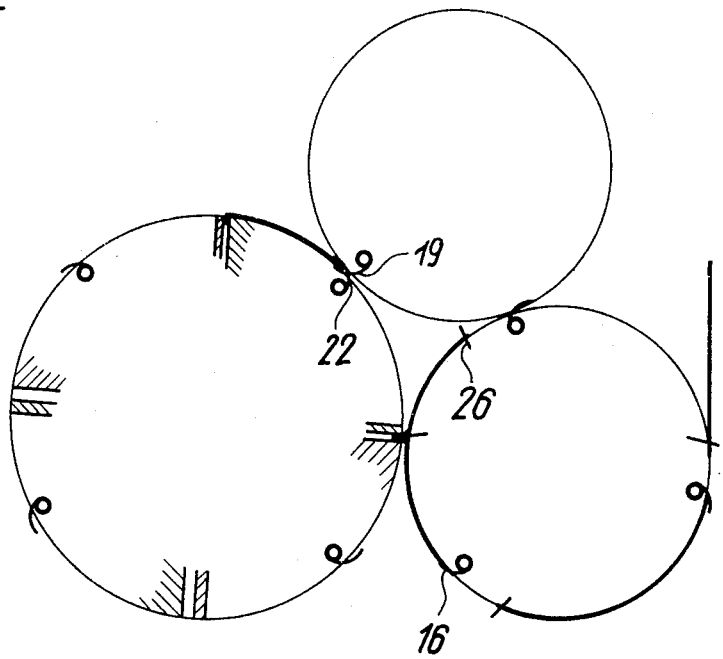
FIG. 5 is a schematic side view showing a further embodiment of the invention wherein points and grippers are utilized.

In accordance with FIG. 4 and 5, the grippers of FIGS. 1 and 2 may be entirely replaced or replaced in part by needles 26, in a known manner and by needles 27, 28 in accordance with the present invention. Needles 27, 28 are oriented radially and obliquely backwards relative to the periphery of the cylinder. The grippers 8, 16 and 19 together with the surface of the cylinder form a mouth, or receptacle, which opens in a direction oriented forwardly of the direction of travel of the sheet. If the sheet is transported exclusively by needles as depicted in FIG. 4, the gap or free space 5 may either be retained or it may be eliminated.

The cylinder 20 may either have a full cylindrical surface or, in order to permit better accessibility to a triangular chamber 29 formed between the triad of cylinders 4, 20 and 23, cylinder 20 may be divided into individual discs (not shown) with free spaces therebetween.

Figure 6:
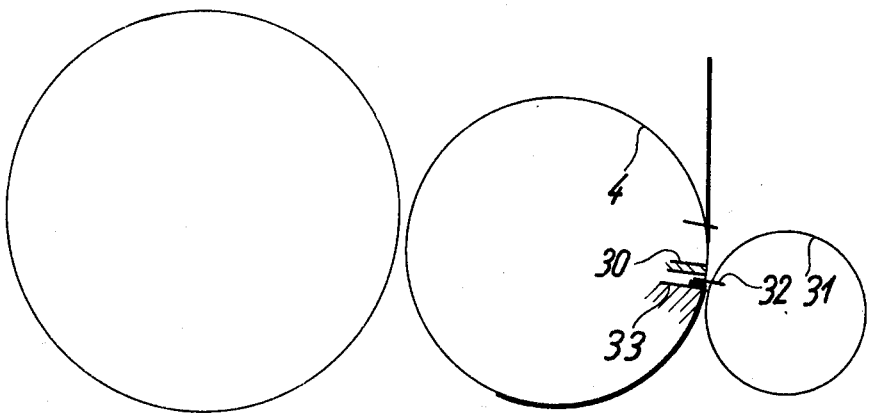
FIG. 6 is a folding device utilizing a flap.

Instead of the gripper means previously disclosed, the trailing edge of the sheet may also be retained by a flap 30 shown in FIG. 6. A cylinder 31 with a blunted, flexible blade 32 operates to push the sheet in against a stop 33 in the cylinder 4 whereupon flap 30 closes, retaining the sheet therein. In this case, as well, the free space or gap 5 may remain or it may be eliminated.

While specific embodiments of the invention have been shown and described in detail to illustrate the application of the inventive principles, it will be understood that the invention may be embodied otherwise without departing from such principles.

What is claimed is:

1. A process for producing a fold in a paper sheet comprising the steps of moving said sheet along a first rotary path upon first rotary means while the leading and trailing edges of said sheet taken relative to the direction of travel of said sheet along said path are supported upon said first rotary means, gripping a portion of said sheet along a line intermediate said leading and trailing edges thereof and withdrawing said gripped sheet by said gripped portion from said first rotary means to about a second rotary means while moving said sheet into a second rotary path about said rotary means to form in said sheet a fold extending transversely to the direction of travel of said sheet along said first path, and supporting and carrying said leading edge of said sheet by gripping said leading edge by third rotary means to hold said leading edge thereon while reversing the direction of travel of said leading edge during formation of said fold as said sheet is drawn along said second rotary path about said second rotary means, said leading edge being directed to move through a portion of a third rotary path defined by said third rotary means simultaneously with movement of said gripped portion of said sheet about said second rotary path.

2. Apparatus for producing a fold in a paper sheet comprising a first, a second, and a third cylinder each rotating relative to each other about parallel axes, means for bringing said sheet into engagement about said first rotating cylinder, said sheet comprising a leading edge and a trailing edge taken relative to the direction of rotation of said first rotating cylinder, holding means on said first rotating cylinder for releasably holding said leading and trailing edges of said sheet, means on said second rotating cylinder for gripping a portion of said sheet along a line intermediate said leading and trailing edges thereof and for thereby withdrawing said gripped sheet by said grip portion from said first rotating cylinder to draw said sheet by engagement along said intermediate line to about said second rotating cylinder while bringing said leading and trailing edges of said sheets into overlapping relationship to form a transverse fold in said sheet along said intermediate line, means for supporting said leading edge of said sheet while said sheet is being drawn to about said second cylinder, said leading edge supporting means including a third rotating cylinder having holding means thereon for gripping said leading edge of said sheet and supporting said leading edge upon said third rotating cylinder while said sheet is being drawn to about said second cylinder.

3. Apparatus for producing a fold in a paper sheet comprising first rotary means for engaging and carrying a sheet to be folded along a first rotary path, said sheet having a leading edge and a trailing edge taken relative to the direction of travel thereof along said first rotary path, said first rotary means including means for releasably holding said leading and trailing edges on said first rotary means as said sheet is moved along said first rotary path, second rotary means including means for gripping said sheet at a portion thereof intermediate said leading and trailing edges thereby to fold said sheet and withdraw said sheet by said gripped portion out of said first rotary path and into a second rotary path, said second rotary path having a rotative directional sense opposite to that of said first rotary path, with engagement and withdrawal of said sheet by said second rotary means operating to cause reversal in the direction of travel of said leading edge of said sheet thereby releasing said leading edge from engagement by said means releasably holding said sheet edges on said first rotary means, and third rotary means having holding means thereon for gripping and supporting said leading edge of said sheet after said leading edge has been released from said first rotary means and while said sheet is being drawn into said second rotary path by said second rotary means, said third rotary means operating to impart to said holding means rotary motion having a rotative directional sense opposite to that of said second rotary path.

* * * * *